US009415487B2

(12) United States Patent
Wilson et al.

(10) Patent No.: US 9,415,487 B2
(45) Date of Patent: Aug. 16, 2016

(54) TOOL SYSTEM FOR HAMMER UNION

(71) Applicant: Concentric Pipe and Tool Rentals, LLC, Harvey, LA (US)

(72) Inventors: David Wilson, Lafayette, LA (US); Chris Murray, Aberdeen (GB)

(73) Assignee: Concentric Pipe and Tool Rentals, LLC, Harvey, LA (US)

( * ) Notice: Subject to any disclaimer, the term of this patent is extended or adjusted under 35 U.S.C. 154(b) by 290 days.

(21) Appl. No.: 14/289,144

(22) Filed: May 28, 2014

(65) Prior Publication Data

US 2014/0260817 A1 Sep. 18, 2014

Related U.S. Application Data

(60) Provisional application No. 61/868,400, filed on Aug. 21, 2013, provisional application No. 61/926,053, filed on Jan. 10, 2014.

(51) Int. Cl.

| | |
|---|---|
| ***B25B 13/50*** | (2006.01) |
| ***B25B 13/02*** | (2006.01) |
| ***B25B 13/08*** | (2006.01) |

(52) U.S. Cl.

CPC ..... *B25B 13/5091* (2013.01); *B25B 13/02* (2013.01); *B25B 13/08* (2013.01); *B25B 13/50* (2013.01)

(58) Field of Classification Search

CPC .... B25B 13/50; B25B 13/5091; B25B 13/02; B25B 13/025; B25B 13/08; B25B 13/48

USPC ..... 81/176.15, 186

See application file for complete search history.

(56) References Cited

U.S. PATENT DOCUMENTS

| | | | | | |
|---|---|---|---|---|---|
| 1,763,353 | A | * | 6/1930 | Walter | B25B 13/02 81/125.1 |
| 1,945,406 | A | * | 1/1934 | Adams | B25B 13/48 81/119 |
| 2,360,163 | A | * | 10/1944 | Sadler | A62C 33/00 81/176.1 |
| 2,712,766 | A | * | 7/1955 | Buttke | B25B 13/107 81/118 |
| 2,758,493 | A | * | 8/1956 | Goldwater | B25B 13/463 81/185.1 |
| 2,830,480 | A | | 4/1958 | Brame | |
| 3,003,379 | A | | 10/1961 | Pribitzer | |
| 3,186,263 | A | | 6/1965 | Grote | |
| 3,847,042 | A | * | 11/1974 | Wilson | B25B 13/00 81/125 |
| 4,095,494 | A | | 6/1978 | Castoe | |
| 4,222,293 | A | * | 9/1980 | Schreyer et al. | B25B 13/46 81/119 |
| 4,440,047 | A | | 4/1984 | Robbins | |
| 4,653,142 | A | | 3/1987 | Upton | |
| 4,930,816 | A | * | 6/1990 | Biing-Yih | B25B 13/02 285/133.4 |
| 5,524,511 | A | * | 6/1996 | Taka's | B25B 13/02 81/124.2 |

(Continued)

OTHER PUBLICATIONS

PCT Application No. US2014/051601; International Search Report and Written Opinion of the International Searching Authority for Applicant Concentric Pipe and Tool Rentals, LLC dated Jan. 13, 2015.

*Primary Examiner* — David B Thomas
(74) *Attorney, Agent, or Firm* — Jones Walker LLP

(57) ABSTRACT

A tool, a tool system, and method for applying torque to a hammer union. The tool includes a handle attached to a tool head, and the tool head further includes at least two indentations, the indentations having a curved rearward wall and forming a mouth with a first width and a mid-section with a second width, wherein the mid-section width is greater than the mouth width.

9 Claims, 10 Drawing Sheets

(56) References Cited

U.S. PATENT DOCUMENTS

| | | | | |
|---|---|---|---|---|
| 5,575,602 | A * | 11/1996 | Savage et al. | B25B 13/02 411/405 |
| 6,314,840 | B2 | 11/2001 | Bozonnet | |
| 6,745,649 | B1 | 6/2004 | Liao | |
| 7,059,424 | B2 * | 6/2006 | Neal et al. | B25B 13/48 173/104 |
| 8,505,879 | B2 * | 8/2013 | Ruan | B25B 13/48 254/232 |
| 8,573,096 | B1 * | 11/2013 | De Los Santos | B25B 19/00 81/118 |
| 9,109,727 | B1 * | 8/2015 | Madson | F16L 19/0218 81/124.3 |
| 9,186,780 | B2 * | 11/2015 | Dumaine et al. | B25B 13/50 81/119 |
| 2005/0000329 | A1 | 1/2005 | Pregeant | |
| 2012/0048069 | A1 | 3/2012 | Powell, Jr. | |
| 2012/0125162 | A1 * | 5/2012 | Nguyen | B23B 31/201 81/124.4 |

* cited by examiner

TOOL SYSTEM FOR HAMMER UNION

CROSS-REFERENCE TO RELATED APPLICATIONS

This application claims the benefit under 35 U.S.C. §119 (e) of U.S. provisional application Ser. Nos. 61/868,400 filed Aug. 21, 2013 and 61/926,053 filed on Jan. 10, 2014, both of which are incorporated by reference herein in their entirety.

BACKGROUND OF INVENTION

The present invention relates to tools for applying torque to various types of connections or fixtures, including hammer union type connections.

Throughout many industries, particularly the oil and gas industry, there are mechanical joints or unions for connecting pipe sections which are generally referred to as "hammer unions." Hammer unions are initially positioned by hand and then, in order to force the final connection so there is no leak in the connection, these unions have what may be described as "upsets" or "dogs" around their surface so that workers may hammer them tightly closed to avoid leakage of high pressure fluids (e.g., up to 15,000 psi) running through the union.

As would be expected over time, since such unions are hammered opened and closed by manually striking the dogs with large hammers, these dogs around the outer rim of the union become warped and bent in the process. More particularly, because the hammer unions are being pounded closed or opened, the threads which engage the pipe between the union and the pipe may become warped or damaged in certain spots, which could compromise the seal the union is intended to form. Due to the high pressure environment, such leakage is very undesirable and may compromise safety. It is known that users may swing a heavy hammer multiple times in order to hit the dogs in tightening and/or loosening the hammer unions. For example, a worker may swing a hammer hundreds of times a day which may cause a serious impact to the unions, not to mention impact or injuries to the worker performing the operation. A safer, more consistent, and less damaging method of tightening and loosening hammer unions would be a significant improvement in the art.

DETAILED DESCRIPTION OF SELECTED EMBODIMENTS

Figure 1:
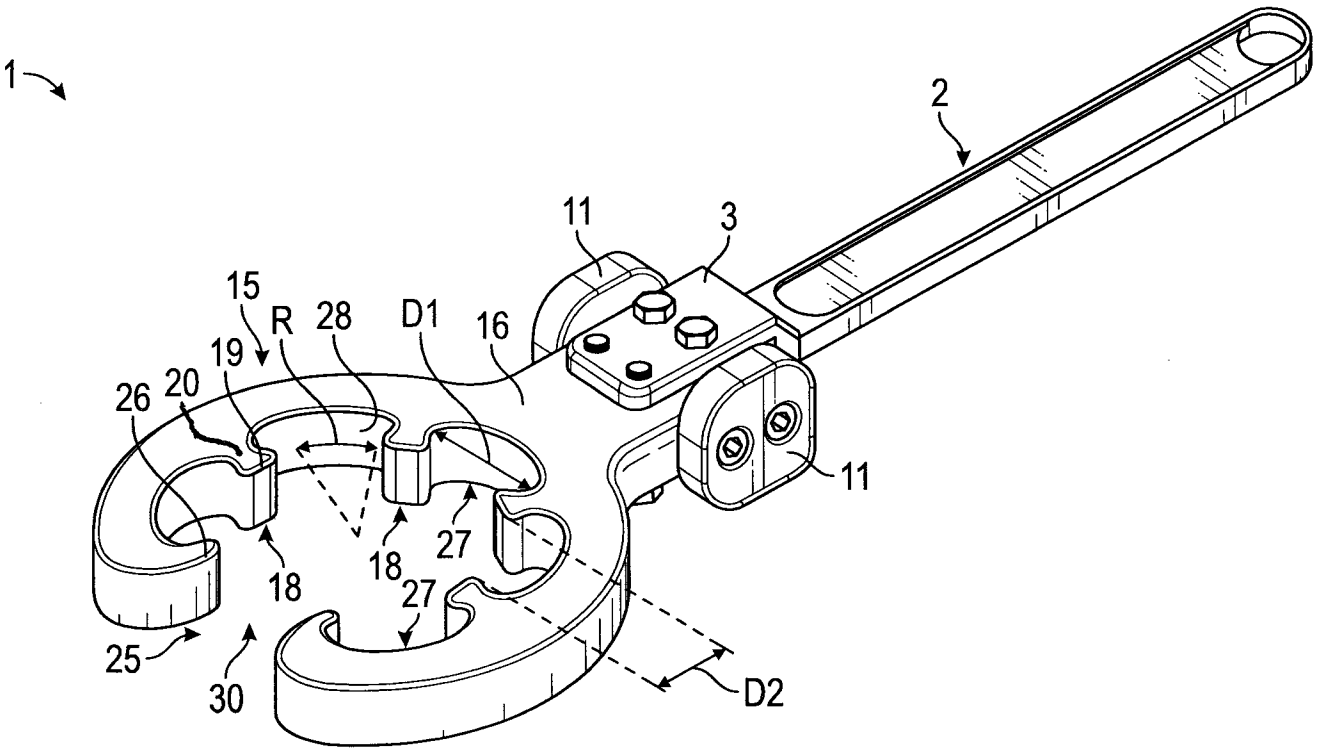
FIG. 1 is a perspective view of one embodiment of the hammer union tool of the present invention.
Figure 3:
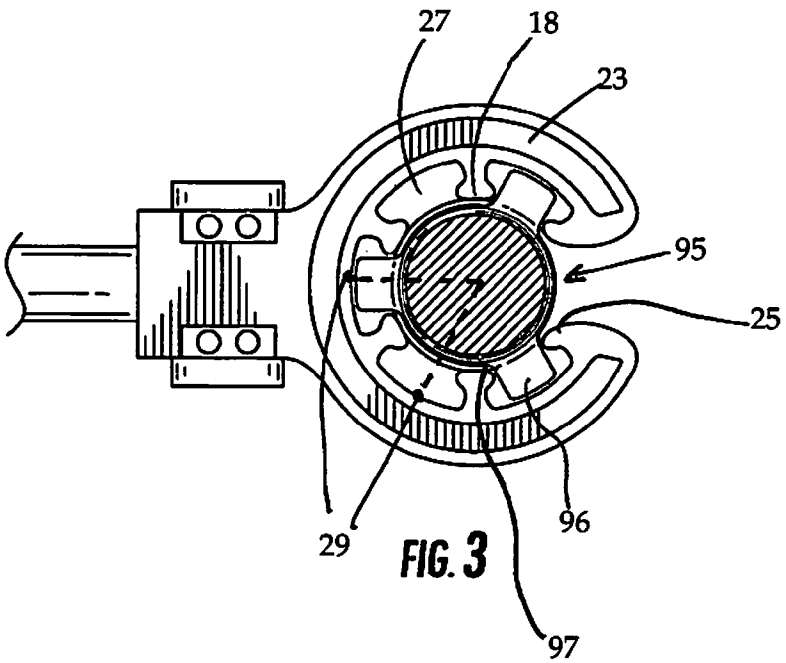
FIG. 3 is a top planar view of the FIG. 2 embodiment.

FIG. 1 illustrates one embodiment of the hammer union tool of the present invention. In the FIG. 1 embodiment, the hammer union tool 1 generally comprises a handle 2 with a fork section 3, which in turn connects to base section 16 of tool head 15. This embodiment of tool head 15 further includes an open throat section 30 and a series of indentations 27 formed in the tool head's interior circumference. These indentations 27 have a curved rearward wall 28 which includes a radius of curvature of "R." In certain embodiments, the radius of curvature may be between about 0.5 inches and about 2.5 inches, but may be outside this range in other embodiments. Each side of the indentations terminates in a tooth member 18 or 25. Several of the tooth members in FIG. 1 are "dual-sided" tooth members 18 in that they separate two adjacent indentations 27 and each side of a tooth member 18 is designed to be the contact surface for a hammer union (as illustrated in FIG. 3). The tooth members 25 on each side of throat section 30 are "single sided" tooth members since they taper to a single point and possess only one surface for contacting a hammer union. Further features of indentations 27 seen in FIG. 1 include a width D1 at the mid-section of the indentations and a width D2 at the mouth of the indentations (i.e., the closest distance between two adjacent tooth members 18). In these embodiments, the mid-section width is greater than the mouth width. In some embodiments, the multiple curved indentation tool head will be described as having a "clover-leaf" pattern.

Figure 4A:
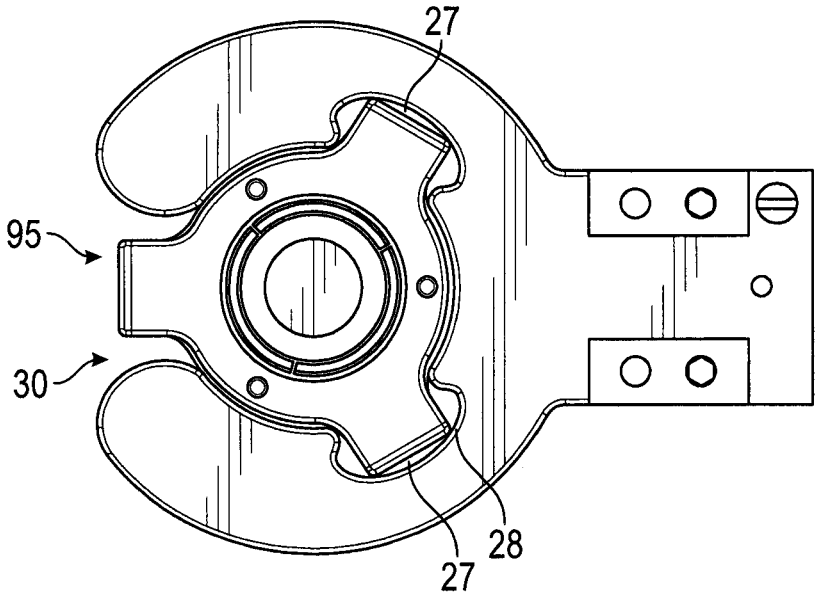
FIG. 4A is a top planar view of a third hammer union tool embodiment.
Figure 5A:
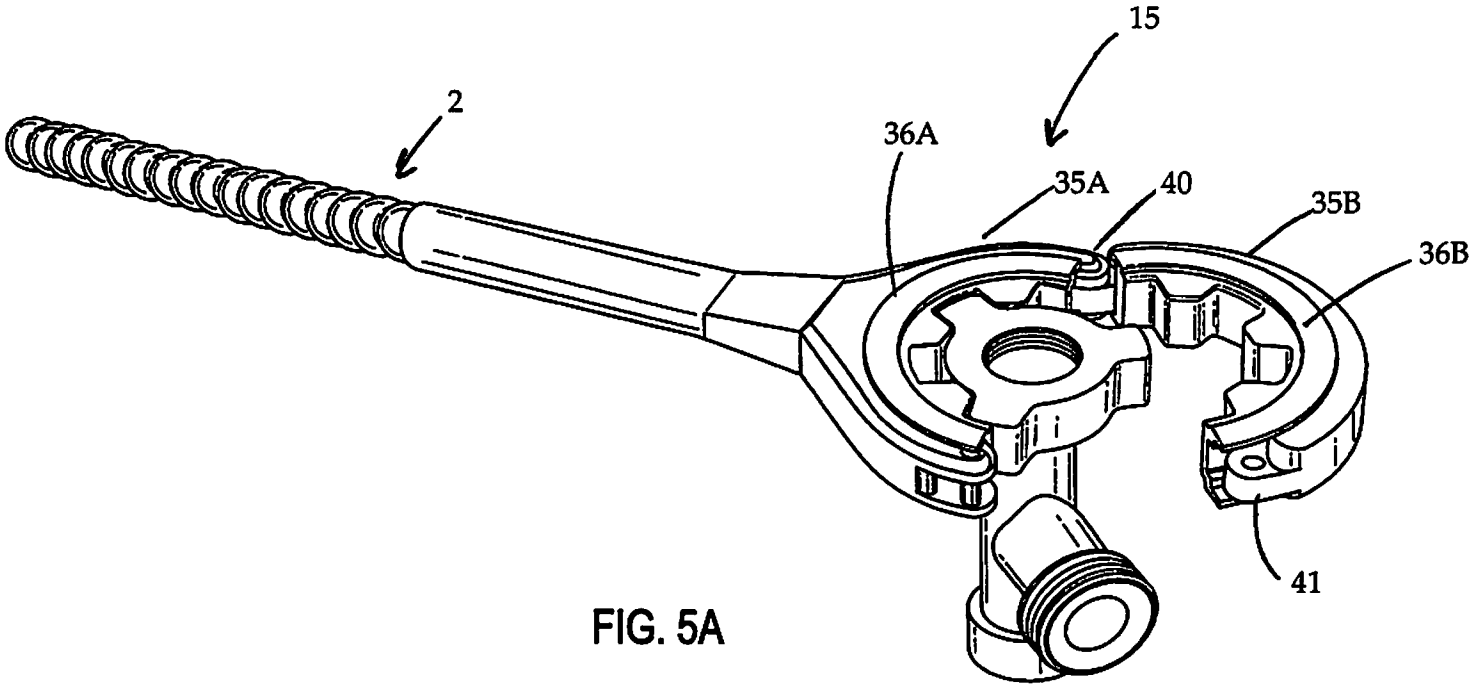
FIGS. 5A to 5C are perspective views of a fifth hammer union tool embodiment.
Figure 5B:
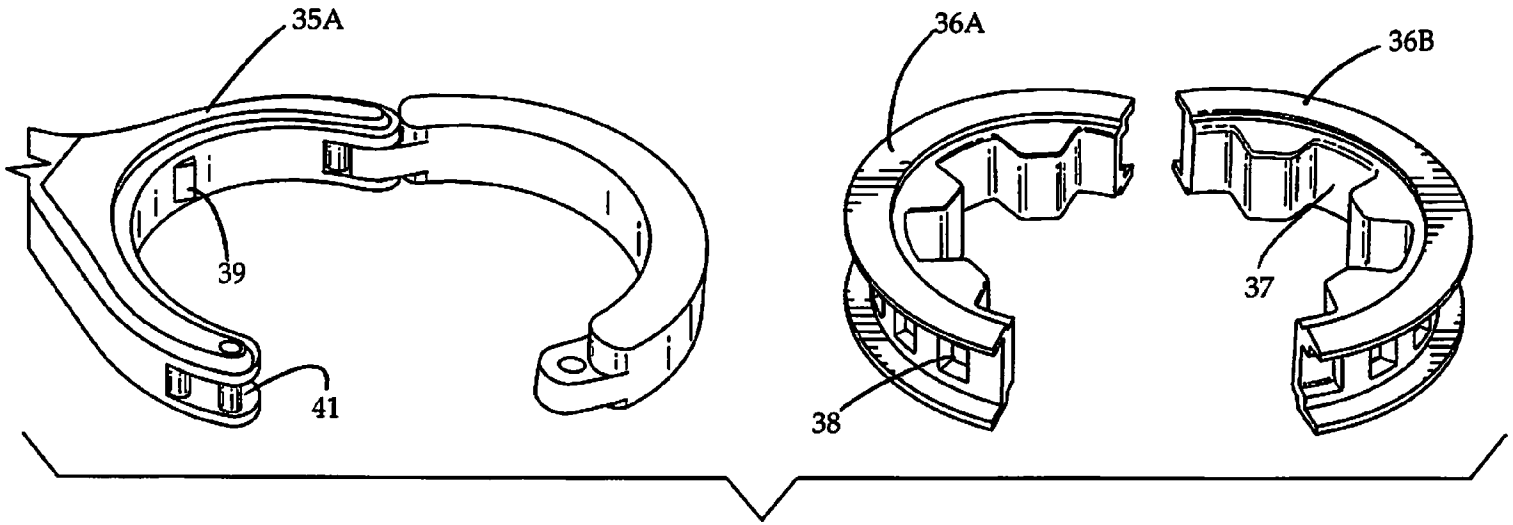
Figure 5C:
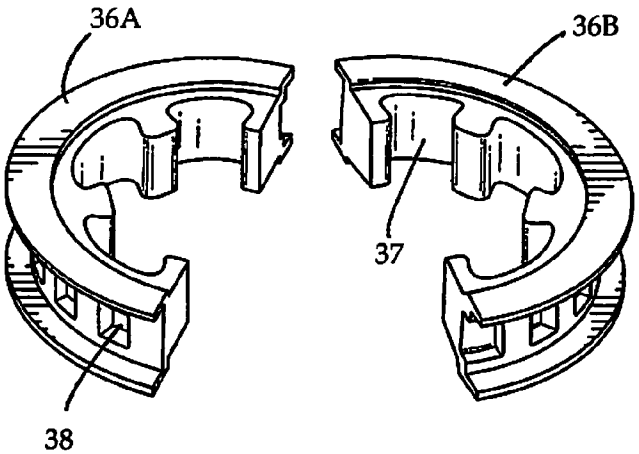
Figures 6A, 6B:
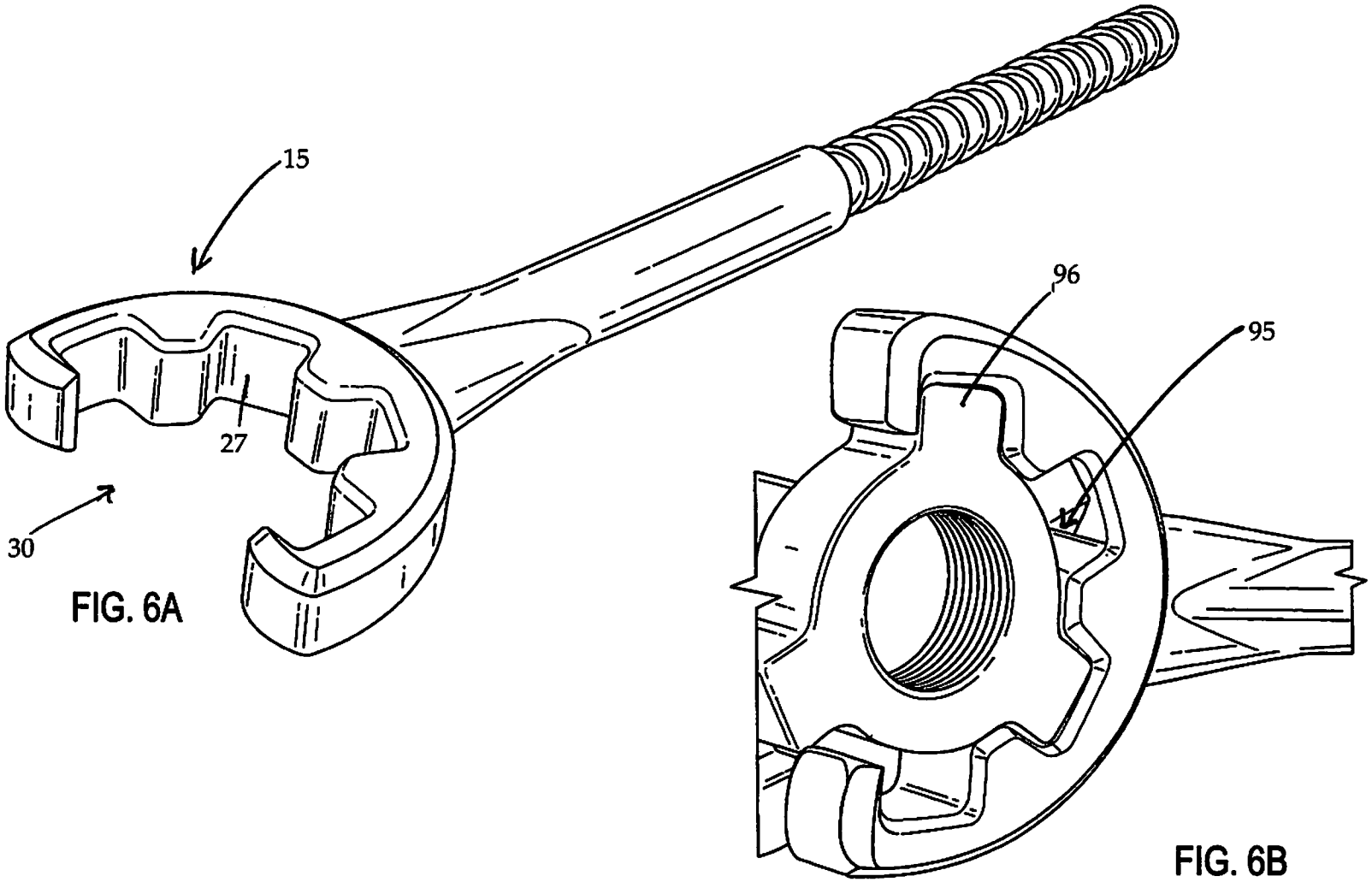
FIGS. 6A to 6C are perspective views of a sixth hammer union tool embodiment.
Figure 6C:
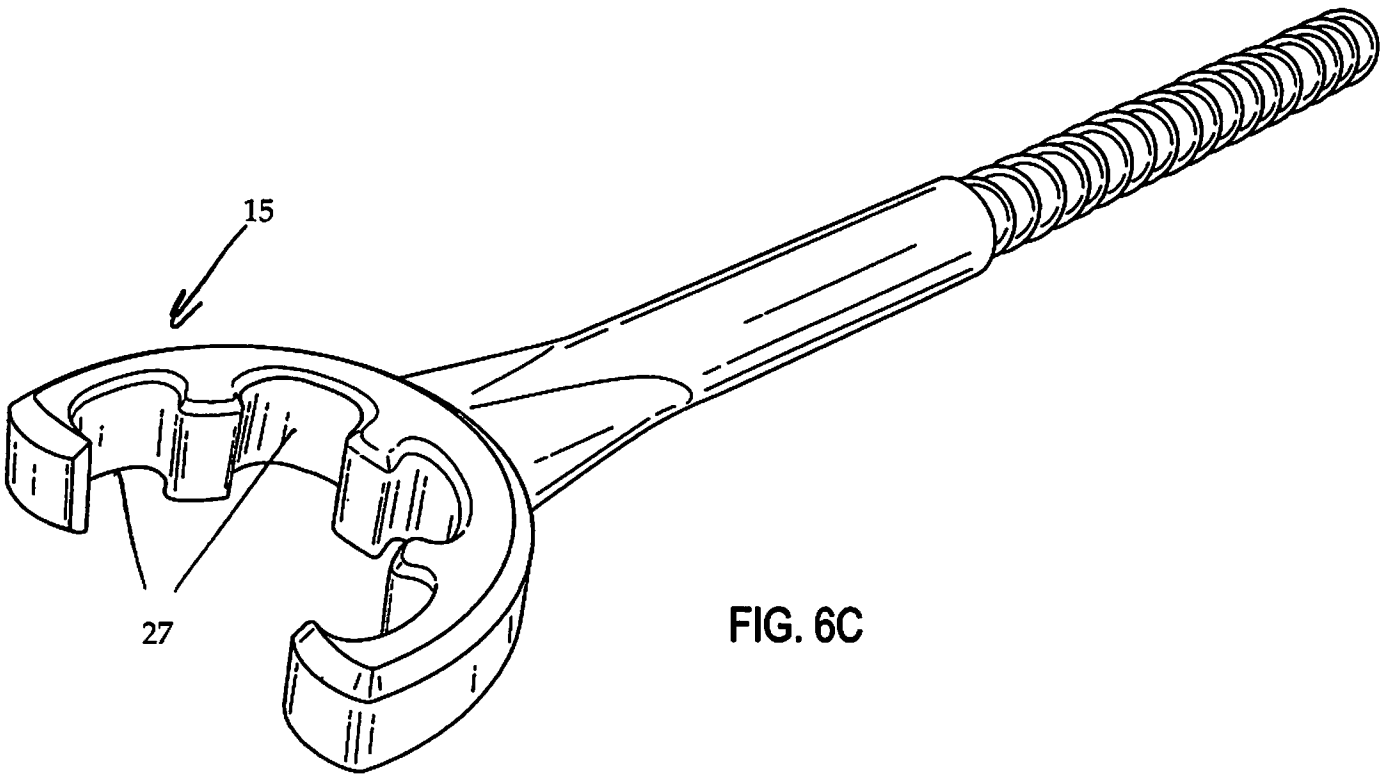

The FIG. 1 embodiment illustrates five indentations 27 in tool head 15, but other embodiments could have more or fewer than five indentations; e.g., one, two, three, four, six, or more indentations (see FIG. 4A showing two indentations, FIG. 6C showing four indentations, or FIG. 5C showing six indentations). FIG. 1 further shows the base section 16 of tool head 15 having two slogging plates 11 attached thereto. In many embodiments, but not necessarily all, the indentations will be spaced (indentation center point 29 to indentation center point 29 in FIG. 3) at about 60° arcs or about 120° arcs. For example, FIG. 3 illustrates adjacent indentation center points 29 spaced 60° apart, while FIG. 4A is an example of indentation center points being 120° apart. In many embodiments, the center of the open throat 30 will have a similar spacing from adjacent indentations 27, i.e., a 60° arc in the case of five indentations or a 120° arc in case of two indentations.

Figure 2:
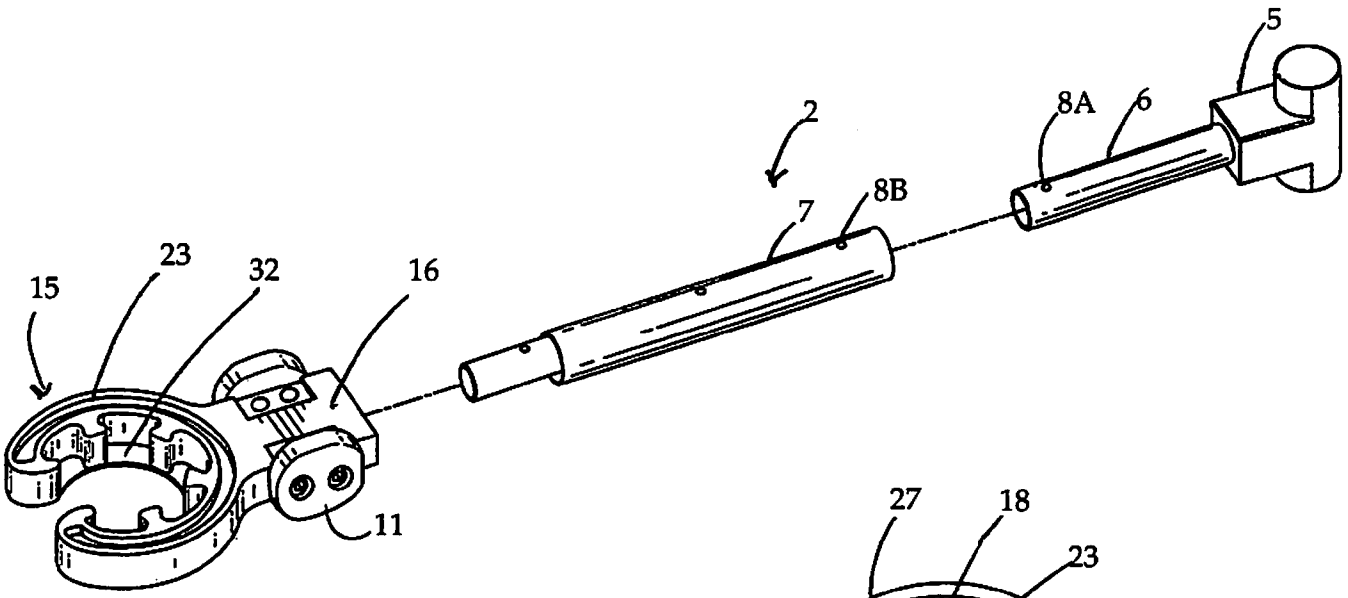
FIG. 2 is an perspective exploded view of a second embodiment of the hammer union tool.

Other embodiments such as suggested in FIG. 2 may include additional features. The FIG. 2 embodiment illustrates stop surfaces 32 extending at least partially over one face of the indentations 27. In this embodiment, the stop surfaces 32 are thin sections of metal covering the lower face ("lower" in the position shown in FIG. 2) of the tool head 15. It may be envisioned how stop surfaces 32 allow the user to position the open or "top" side of the indentations 27 over a hammer union, but will prevent the hammer union from passing through the bottom side of the indentations. Thus, stop surfaces 32 assist in rapid and secure positioning of the tool 1 on the hammer union.

FIG. 2 also illustrates how this embodiment will include an adjustable, telescoping handle section 2. Telescoping insert 6 will side into handle extension 7 and be fixed into position by a pin engaging pin apertures 8A and 8B. Handle extension 7 may be secured to tool head base section 16 by a similar pinning method. In the FIG. 2 embodiment, the end of telescoping insert 6 includes the hammer section 5, which can be used in conjunction with slogging plates 11. Slogging plates 11 provide a striking surface if the hammer section 5 or a similar tool is used to moderately tap the hammer union tool in order to transmit a modest shock load to the hammer union joint.

The tool head can be virtually any size, but in many embodiments, the tool head is designed (sized) to engage a standard hammer union typically designated as 1", 2", 3", 4", 5", or 6". In these examples, the radius from a center of the tool head to the rear wall 28 of the indentations 27, depending on tool size, is between about 2 and 10 inches. FIG. 3 illustrates the tool head engaging the conventional hammer union 95, which has three upsets 96 (the upsets also sometimes referred to as "pegs," "dogs," or other similar terms). FIG. 3 suggests how the enlarged indentations 27 would be capable of fitting around the upsets 96 even in instances where the upsets have been significantly deformed through previous heavy use (e.g., where the upsets have been struck repeatedly with heavy hammers). In particular, FIG. 3 suggests how teeth 18 will tend to engage hammer union 95 at each shoulder portion 97 associated with an upset 96, thereby applying a uniform torque load on each upset of the hammer union 95.

Figure 4B:
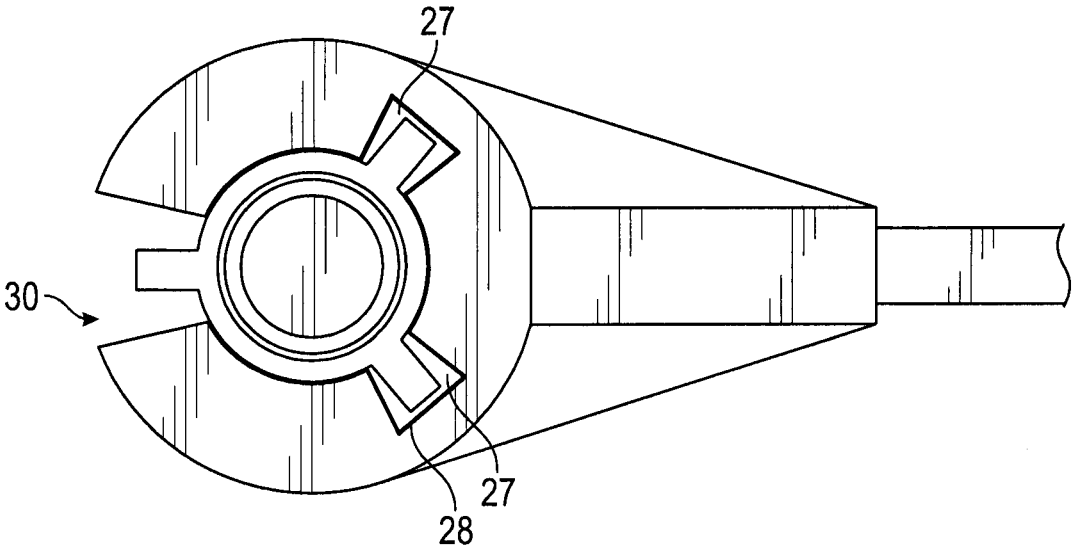
FIG. 4B is a top planar view of a fourth hammer union tool embodiment.

As suggested above, FIG. 4A illustrates an embodiment of tool head 15 having only two indentations 27 for engaging the hammer union upsets 96. In FIG. 4A, the indentations have the curved rearward wall 28 described in reference to FIG. 1. Alternatively, the embodiment of FIG. 4B illustrates an embodiment of tool head 15 where the indentations 27 have straight rear walls 28. However, the indentations 27 become progressively wider as they extend in the direction running from the center of the tool head toward the outer circumference of the tool head. Thus, as with previously described indentations 27, those of FIG. 4B are narrow at the mouth of the indentation and wider at the mid-section width of the indentation. In FIG. 4B, the indentations have the greatest width at the rear wall 28.

FIGS. 5A to 5C illustrate another embodiment of the invention. This embodiment includes a hammer union tool with a ratcheting mechanism. The tool head 15 comprises two hinged sections (or partial ring segments) 35A and 35B, which are joined at hinge 40 and can transition between an open ring configuration and a closed ring configuration where locking latch 41 secures together the sections 35A and 35B. In FIGS. 5A and 5B, locking latch 41 is a simple pin on section 35A engaging a pin aperture on section 35B. Positioned within the hinged sections 35A and 35B are two partial ring shaped insert pieces 36A and 36B seen in FIG. 5B. Both insert pieces 36A and 36B will include a series of ratchet notches 38 positioned around their outer perimeter. Indentations 37 for engaging hammer union upsets will be formed on the inner perimeter of insert pieces 36A and 36B. The ratchet notches 38 interact with the ratchet tongue 39 positioned within hinged section 35A. Although not explicitly shown, a spring or other biasing means will bias ratchet tongue 39 outward (as shown in FIG. 5B), but allows ratchet tongue 39 to deflect into the body of hinged section 35A. It may be envisioned how ratchet tongue 39 will deflect inward when the insert pieces rotate clockwise (i.e., letting the ratchet notches 38 pass). However, when the insert pieces rotate counter-clockwise, the ratchet tongue 39 will engage a ratchet notch 38 and prevent rotation of the insert pieces 36, thereby allowing the wrench to apply torque in that angular direction.

It can be seen that the insert pieces 36A and 36B in FIG. 5B have generally square indentations 37. One alternative design is seen in the insert pieces 36A and 36B illustrated in FIG. 5C. These FIG. 5C insert pieces 36A and 36B have curved indentations 37 with the characteristics described in reference to FIG. 1 above. Although the embodiments in FIGS. 5A to 5C illustrate six indentations in the tool head, other embodiments could certainly encompass fewer than six indentations (e.g. three indentations) or in specialized embodiments, potentially more than six indentations.

FIGS. 6A to 6C illustrate a still further embodiment. In FIGS. 6A to 6C, the tool head 15 generally comprises an arc of only about 180° and provides a much more open throat area 30. The illustrated embodiments include four indentations 27 which will engage two upsets 96 on the hammer union 95 as suggested in FIG. 6B. Again, alternative designs could have fewer (or possibly more) indentations 27. While FIG. 6A shows a tool with square indentations 27, FIG. 6C shows the indentations with curved rear walls as seen in FIG. 1.

Figure 7A:
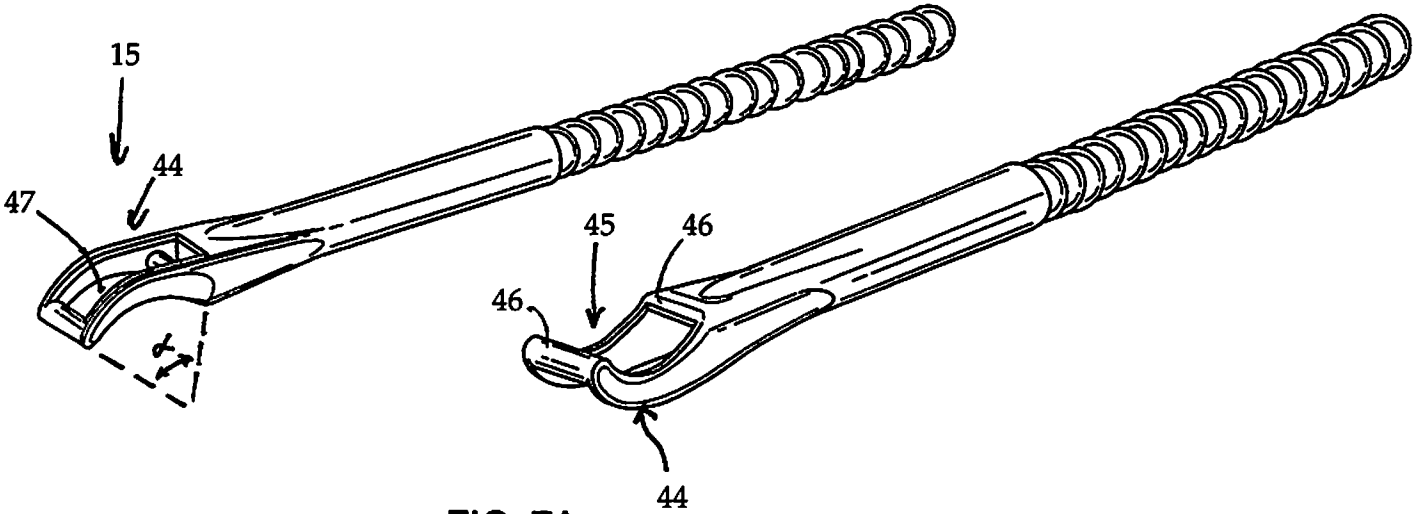
FIGS. 7A to 7E are perspective views of a seventh hammer union tool embodiment.
Figure 7B:
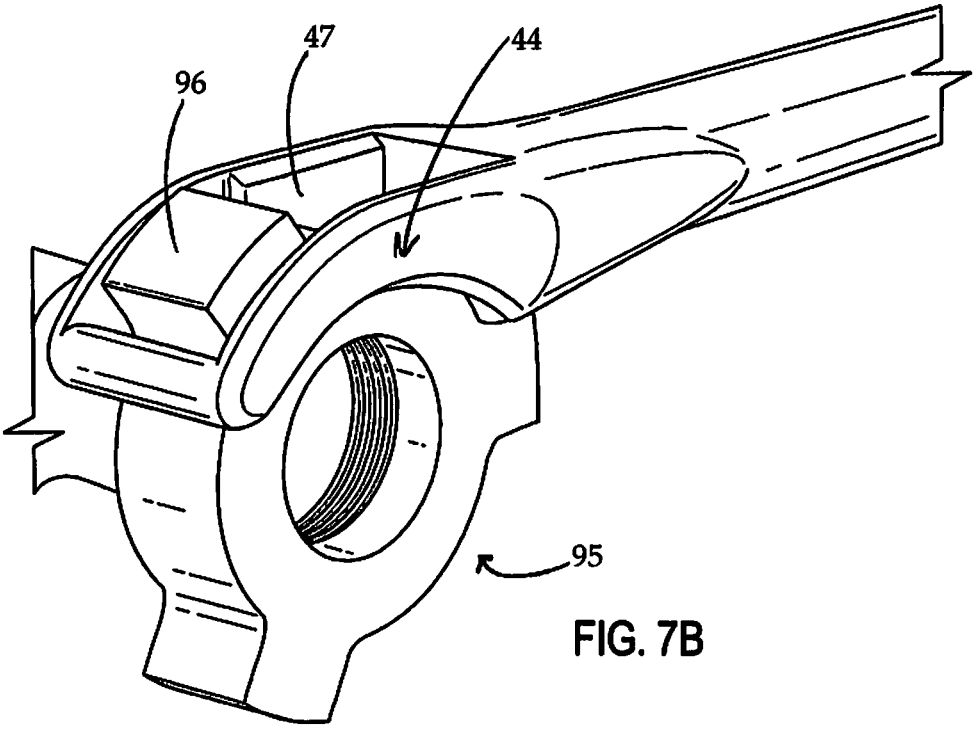
Figure 7C:
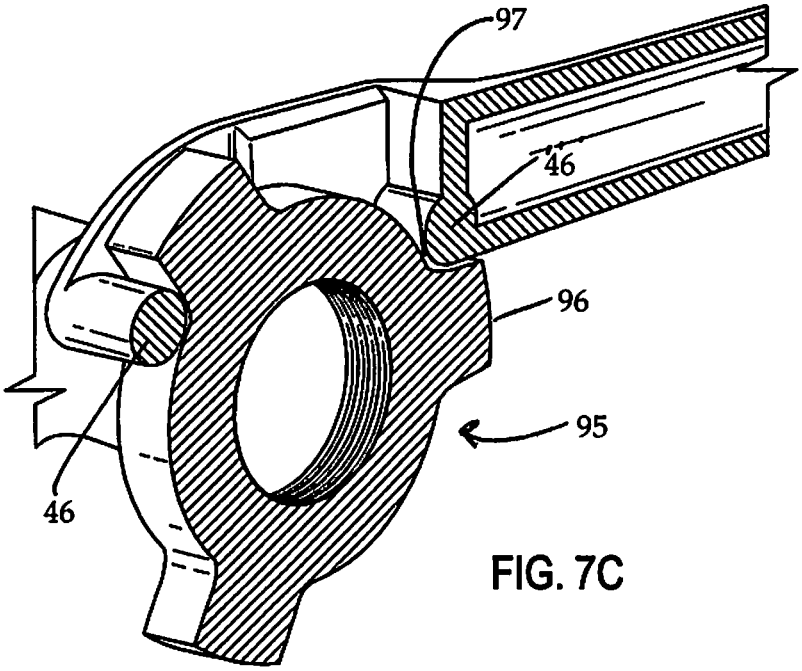
Figure 7D:
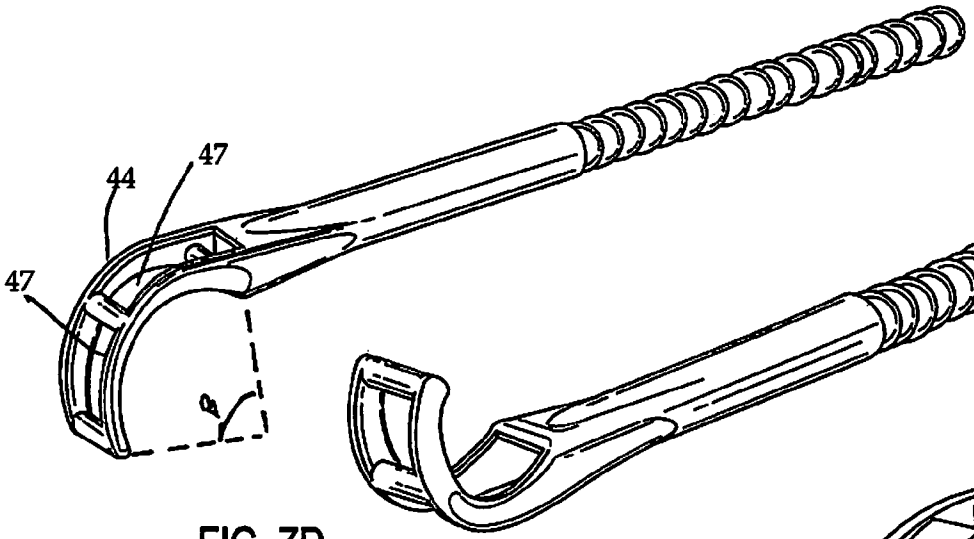
Figure 7E:
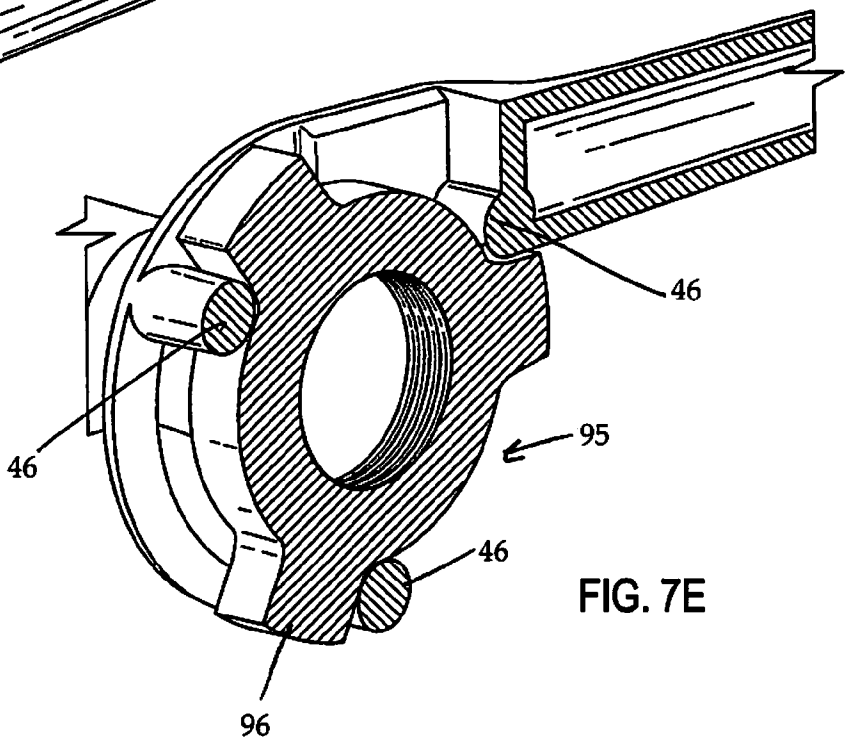

FIGS. 7A to 7D illustrate one further embodiment in which tool head 15 takes on a significantly different configuration from previous embodiments. The tool head 15 is formed of an arcuate body section 44 which leaves an open face section 45. Additionally, an aperture 47 is formed through the rear surface of arcuate body section 44. In the FIG. 7A embodiment, the arcuate body section has an arc length alpha of about 120°. Similarly, the tool head includes two lug members 46 position on each end of the body section, i.e., the lug members 46 are spaced about 120° apart. As will be apparent from FIGS. 7B and 7C, the 120° spacing of lug members 46 allows them to engage the hammer union upsets 96 (or shoulders 97 at the base of upsets 96) of hammer union 95. FIGS. 7B and 7C also illustrate how rear aperture 47 allows the hammer union upset 96 to readily extend at least partially into or through arcuate body section 44 to the extent needed for the tool head to be easily placed on the hammer union 95. FIGS. 7D and 7E suggest how this design may be modified such that arcuate body section 44 has an arc length beta of about 240° and includes two rear apertures 47 and three lug members 46. As is clear from FIG. 7E, this allows the tool head to engage all three upsets 96 on the hammer union 95.

The terms used in the specification will generally have the meaning ascribed to them by persons skilled in the art, unless otherwise stated. The term "about" will typically mean a numerical value which is approximate and whose small variation would not significantly affect the practice of the disclosed embodiments. Where a numerical limitation is used, unless indicated otherwise by the context, "about" means the numerical value can vary by ±10%, or in certain embodiments ±5%, or even possibly as much as ±20%. Although the foregoing invention has been described in terms of specific embodiments, those skilled in the art will recognize many obvious modifications and variations. All such modifications and variations are intended to fall within the scope of the following claims.

The invention claimed is:

1. A tool for applying torque to a hammer union having three upsets, the tool comprising:

(i) a handle attached to a tool head, (ii) at least two indentations formed in the tool head, the indentations having a curved rearward wall and forming a mouth with a first width and a mid-section with a second width, wherein the mid-section width is greater than the mouth width; and (iii) teeth formed at opposing edges of the indentations, wherein at least one tooth is a dual face tooth including a mid-portion and an enlarged end portion wider than the mid-portion.

2. The tool according to claim 1, further comprising at least three indentations spaced to accommodate three upsets of a hammer union joint.

3. The tool according to claim 2, wherein a center of the three indentations are spaced at about 120° arcs from one another.

4. The tool according to claim 2, wherein the indentations form a clover-leaf pattern within the tool head.

5. The tool according to claim 1, wherein at least one tooth is a single face, tapered point tooth.

6. The tool according to claim 1, wherein one face of the tool head further comprises at least one stop surface extending at least partially over at least one of the indentations.

7. The tool according to claim 1, wherein the tool head has an open throat section.

8. The tool according to claim 7, wherein single face, tapered teeth flank the open throat section.

9. The tool according to claim 1, wherein the handle comprises at least two telescoping sections.

* * * * *